US007472480B2

(12) United States Patent
Igarashi et al.

(10) Patent No.: US 7,472,480 B2
(45) Date of Patent: Jan. 6, 2009

(54) METHOD FOR PRODUCING LIQUID EJECTING RECORDING HEAD

(75) Inventors: Koichi Igarashi, Kanagawa (JP); Shogo Ono, Kanagawa (JP); Manabu Tomita, Kanagawa (JP); Minoru Kohno, Tokyo (JP); Shigeru Ushiki, Saitama (JP); Shohei Makita, Saitama (JP)

(73) Assignees: Sony Corporation, Tokyo (JP); Taiyo Ink Mfg. Co., Ltd., Tokyo (JP)

( * ) Notice: Subject to any disclaimer, the term of this patent is extended or adjusted under 35 U.S.C. 154(b) by 171 days.

(21) Appl. No.: 11/460,332

(22) Filed: Jul. 27, 2006

(65) Prior Publication Data

US 2007/0030317 A1 Feb. 8, 2007

(30) Foreign Application Priority Data

Aug. 8, 2005 (JP) ..... P2005-229864

(51) Int. Cl.
*B21D 53/16* (2006.01)
*B41J 2/045* (2006.01)

(52) U.S. Cl. ..... 29/890.1; 29/25.35; 29/611; 347/68; 427/100; 427/208.2; 427/208.4

(58) Field of Classification Search ..... 29/611, 29/25.35, 890.1, 832, 831, 830; 347/56, 347/68–70, 100, 102; 216/29, 44, 47, 45, 216/54–56; 427/487, 100, 207.1, 208, 208.2, 427/208.6, 208.8; 264/425, 459, 171.28, 264/172.18, 173.19

See application file for complete search history.

(56) References Cited

U.S. PATENT DOCUMENTS

| | | | | |
|---|---|---|---|---|
| 4,418,355 | A * | 11/1983 | DeYoung et al. | 347/70 |
| 6,472,129 | B2 * | 10/2002 | Noguchi et al. | 430/326 |
| 6,582,060 | B1 * | 6/2003 | Kitakami et al. | 347/56 |
| 2003/0112307 | A1 * | 6/2003 | Maeda et al. | 347/102 |
| 2005/0046662 | A1 | 3/2005 | Akihiko | |

FOREIGN PATENT DOCUMENTS

| | | |
|---|---|---|
| WO | 2006-078069 | 7/2007 |

OTHER PUBLICATIONS

EP Communication dated Jul. 18, 2008 for Application No. 06016152.8-1251.

* cited by examiner

*Primary Examiner*—Peter Vo
*Assistant Examiner*—Tai Nguyen
(74) *Attorney, Agent, or Firm*—Sonnenschein Nath & Rosenthal LLP

(57) ABSTRACT

Disclosed is a liquid ejecting recording head with improved operational reliability. A first coating resin layer of a liquid ejecting recording head, having a liquid flow duct and a liquid ejecting orifice, is formed of an oxetane resin composition that contains, as necessary components, an oxetane compound having at least one oxetanyl group in a molecule, and a cationic photopolymerization initiator.

8 Claims, 6 Drawing Sheets

METHOD FOR PRODUCING LIQUID EJECTING RECORDING HEAD

CROSS REFERENCE TO RELATED APPLICATIONS

The present invention contains subject matter related to Japanese Patent Application JP 2005-229864 filed in the Japanese Patent Office on Aug. 8, 2005, the entire contents of which being incorporated herein by reference.

BACKGROUND OF THE INVENTION

1. Technical Field

This invention relates to a method for producing a recording head of the liquid ejecting type which exhibits low stress and high resistance against chemicals and which includes a plural number of flow ducts formed to high accuracy by patterned shaping by e.g. radiation of ultraviolet light.

2. Description of Related Art

Among the liquid ejecting type recording heads, there is an ink jet recording head applied to the ink jet recording system, ejecting e.g. the ink as liquid (liquid jet recording system). This ink jet recording head includes several constituent units, namely a plural number of ejecting orifices (orifices) ejecting the ink in a finely divided form, a plural number of flow ducts communicating with these ejecting orifices, and by a plural number of ink ejecting pressure generating devices, provided in certain portions of the flow ducts. For generating a high quality image with such ink jet recording head, it is preferred that small ink droplets, discharged from the ejecting orifices, are discharged with the same volume and at the same ejecting speed at all times from the respective ejecting orifices.

Among the ink jet recording heads, realizing these ejecting conditions, there are those stated for example in the following Patent Publication 1 (JP Laid-Open Patent Publication S56-123869), Patent Publication 2 (JP Laid-Open Patent Publication S57-208255), and Patent Publication 3 (JP Laid-Open Patent Publication S57-208256). In the ink jet recording head, disclosed in the Patent Publications 1 to 3, a plural number of nozzles, each including an ink flow duct and an orifice part, are patterned with e.g. a photosensitive resin material or a photoresist, on a substrate carrying a plural number of ink ejecting pressure generating devices. On a component part, carrying the ink flow ducts and the orifice parts, there is bonded a lid formed by, for example, a glass plate. Examples of the photosensitive resin material or the photoresist include diazo resin, p-diazoquinone, photo-polymerized photopolymers, containing vinyl monomers and a polymerization initiator, dimerized photopolymers, employing e.g. polyvinyl cinnamate and a sensitizer, a mixture of orthoquinone diazide and a phenol novolak resin, and a mixture of polyvinyl alcohol and diazo resin. Other examples include polyether photopolymers, obtained on copolymerization of 4-glycidyl ethylene oxide with benzophenone or glycidyl calcone, an N-N-dimethyl methacryl amide-acrylamide benzophenone copolymer, unsaturated polyester based photosensitive resin, unsaturated urethane-based photosensitive resin, and a photosensitive composition obtained on mixing a difunctional acrylic monomer with a photopolymerization initiator and a polymer. Further examples include a dichromate photoresist, a non-chromium-based water-soluble photoresist and a polyvinyl cinnamate based photoresist.

Other ink jet recording heads, satisfying the aforementioned conditions for ejecting, may be exemplified by an ink jet recording head, obtained by a method for preparation as disclosed in Patent Publication 4 (JP Laid-Open Patent Publication S61-154947), indicated below. In the method for the preparation of the ink jet recording head, disclosed in the Patent Publication 4, a plural number of ink flow duct patterns are formed on the site of the substrate, which become to be ink flow ducts, with a dissolvable resin, and the so formed ink flow duct patterns are coated with an epoxy resin. The substrate is then severed, and the dissolvable resin, which forms the ink flow duct patterns, is dissolved and removed to yield an ink jet recording head.

There is also such an ink jet recording head in which, in contrast to those shown in the Patent Publications 1 to 4, a plural number of electrical thermal transducers, as the ink ejecting pressure generating devices, are mounted facing the ejecting orifices, with the direction of growth of the air bubbles, formed on the electrical thermal transducers, being substantially the same as the ink ejecting direction. Examples of this type of the ink jet recording head are disclosed in the Patent Publication 5 (JP Laid-Open Patent Publication S58-8658) and Patent Publication 6 (JP Laid-Open Patent Publication S62-264957), indicated below. In the ink jet recording head, disclosed in Patent publication 5, a dry film, which later becomes an orifice plate, is bonded on a substrate, provided with the electrical thermal transducers, with another patterned dry film. A plural number of ejecting orifices are formed by a photolithographic technique on the sites facing the electrical thermal transducers of the dry film and which later become an orifice plate. In the ink jet recording head, disclosed in Patent Publication 6, the substrate, carrying the ink ejecting pressure generating devices, and an orifice plate, prepared by electrocasting, are bonded together via a patterned dry film.

Moreover, in the ink jet recording heads, it is necessary not only to eject the ink with the same volume and at the same ejecting speed via ink ejecting orifice but also to eject fine ink droplets at accurately set positions. In order for the ink jet recording head to eject the ink at these accurately set locations, the distance between the electrical thermal transducer and the ejecting orifice, referred to below as 'OH' distance, is desirably as short as possible.

An illustrative method for producing an ink jet recording head, the OH distance of which has been set to high accuracy, is disclosed in Patent Publication 7 (JP Laid-Open Patent Publication H6-286149). In this Patent Publication 7, there is disclosed a method for preparation of an ink jet recording head including an ink flow duct pattern forming step, a coating resin layer forming step and a dissolvable resin layer dissolving step. In the ink flow duct pattern forming step, an ink flow duct pattern, which later becomes an ink flow duct, is formed by a dissolvable resin on a substrate already carrying ink ejecting pressure generating devices. In the coating resin layer forming step, the coating resin, containing an epoxy resin, solid at ambient temperature, is dissolved in a solvent and applied by solvent coating on a dissolvable resin layer, forming an ink flow duct pattern, to form a coating resin layer, which later becomes a wall section of an ink flow duct, on the dissolvable resin layer. In the resin layer dissolving step, the dissolvable coating layer, forming the ink flow duct pattern, is dissolved. In the method for producing an ink jet recording head, described in Patent Publication 7, a cationic polymer of an alicyclic epoxy resin is used as the coating resin from the viewpoint of forming a high aspect ratio pattern and of assuring high resistance against the ink.

SUMMARY OF THE INVENTION

In the ink jet recording head, disclosed in the Patent Publications 1 to 4, a plural number of heater resistors, provided in preset portions of the ink flow ducts to become ink ejecting pressure generating devices, are mounted along a line parallel to the ink flow direction. The ink ejecting orifices are provided at terminal parts of the ink flow ducts for extending at right angles to the ink flow direction. In this type of the ink jet recording head, since the ink ejecting orifices are arranged substantially at right angles to the line of the heater resistors, the ink ejecting direction is perpendicular to the direction of growth of air bubbles on the resistor heaters, that is, the direction of growth of the air bubbles differs from the direction of ink emission.

In the ink jet recording heads, since a portion of the ejecting orifice, disposed at a terminal end of the ink flow duct, is formed by the terminal end of the substrate, the distance between the ink ejecting pressure generating device and the ejecting orifice is set as a result of severing the substrate. Thus, in controlling the distance between the ink ejecting pressure generating device and the ejecting orifice, the accuracy with which the substrate is severed is critical. The practice in severing a substrate is to use a mechanical device, such as a dicing saw. However, with this mechanical device, it is difficult to realize the high accuracy desired.

In the ink jet recording heads, disclosed in these Patent Publications 5 and 6, the orifice plates are of a thin thickness of, for example, 20 μm or less. Moreover, it is difficult to fabricate the orifice plate to a uniform thickness. Even granting that the orifice plate has been prepared, it is extremely difficult to join the orifice plate to the substrate, already carrying the ink ejecting pressure generating devices, because of fragility of the orifice plate.

On the other hand, in the ink jet recording head, the following problems have newly been met due to use of the methods and the materials disclosed in Patent Publication 7 and Patent Publication 8 (JP Laid-Open Patent Publication H7-214783).

The cured cationic polymer of the alicyclic epoxy resin has a high bonding power with respect to the underlying substrate. However, the polymer has high inner stress and hence is likely to peel off from the underlying substrate. Moreover, the polymer is subjected to cracking (film cleavage) in a corner portion where stress concentration is likely to be produced, thus severely detracting from the reliability of the ink jet recording head. In addition, among the materials, disclosed in the above Patent Publications, there are many materials which are insufficient in the patterning performance and with which the delicate patterning performance, necessary for the ink jet recording head structures, may not be achieved.

In the ink jet recording head, the coating resin layer tends to be peeled off or cracked, especially in case the resin layer is of an elongated length, in case the coating resin layer, operating as ink flow duct wall section, is thicker in thickness, or in case the ink flow duct presents an intricate or complicated structure. Moreover, in the ink jet recording head, the operation of cleaning the surface of the head, from which the ink is ejected, for removing excess ink affixed to the recording head, may not be dispensed with, in order to maintain the printing quality. In cleaning the ink jet recording head, the head surface is wiped with a cleaning member. Hence, there is applied mechanical load on the head surface, as a result of which the coating resin layer is apt to peel off from the substrate.

Hence, it is desirable to provide a method for producing a liquid emission recording head which is low in stress and which has a coating film which allows for accurate and facilitated pattern shaping by for example irradiation of ultraviolet rays.

According to an embodiment of the present invention, there is provided a method for producing a liquid ejecting recording head. The method includes a step of forming a liquid flow duct pattern, from a dissolvable resin, in a portion of a substrate carrying a liquid ejecting energy generating device, which portion later becomes a liquid flow duct. The method also includes a step of forming a coated resin layer on the dissolvable resin on which the liquid flow duct pattern has been formed, a step of forming a liquid ejecting opening in a portion of the coating resin layer overlying the liquid ejecting energy generating device, and a step of dissolving the dissolvable resin. The coating resin layer is formed of an oxetane resin composition that contains, as necessary components, an oxetane compound having at least one oxetanyl group in a molecule, and a cationic photopolymerization initiator. In the coated resin layer forming step, such a solution of feedstock components of the oxetane resin composition and the cationic photopolymerization initiator dissolved in a solvent which does not dissolve the dissolvable resin, is used, and a cured product of the feedstock components of the solution is generated. The dissolvable resin is dissolved to exit the liquid ejecting opening to form the liquid flow duct communicating with the liquid ejecting opening.

According to the present invention, in which the coated resin layer, forming a liquid flow duct and a liquid ejecting orifice of a liquid ejecting recording head, is formed of an oxetane resin composition, the coated resin layer may be reduced in the stress to prevent cracking and exfoliation from the substrate of the coated resin layer. This gives a liquid ejecting recording head exhibiting superior durability. Moreover, according to the present invention, resistance against chemicals may be obtained by forming the coated resin layer of the oxetane resin composition. Thus, according to the present invention, there may be obtained a liquid ejecting recording head improved in manufacture yield and product quality and exhibiting high reliability for an extended period of time.

DESCRIPTION OF THE PREFERRED EMBODIMENTS

Figure 1:
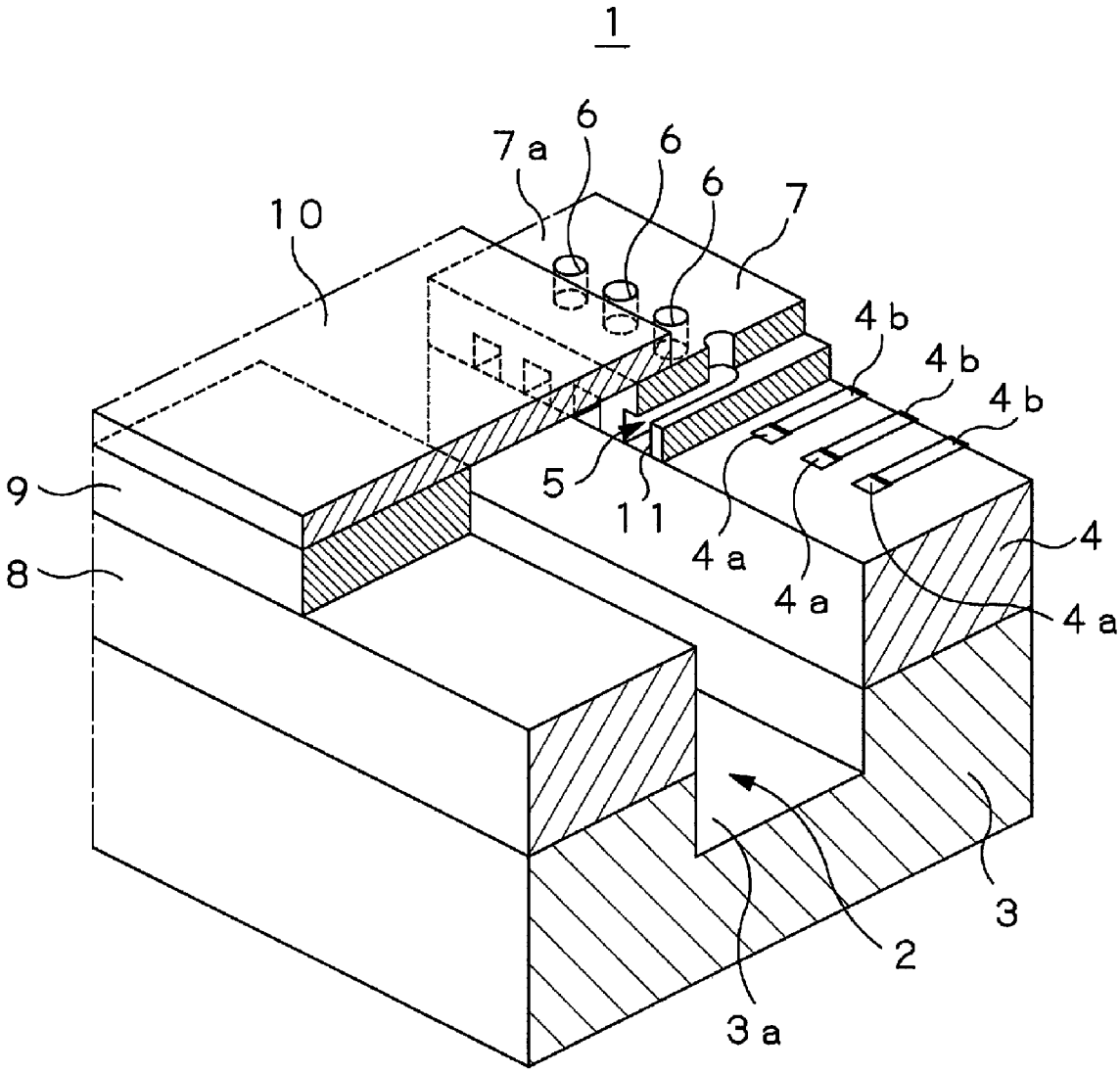
FIG. 1 is a perspective view of an ink jet recording head according to an embodiment of the present invention.
Figure 2:
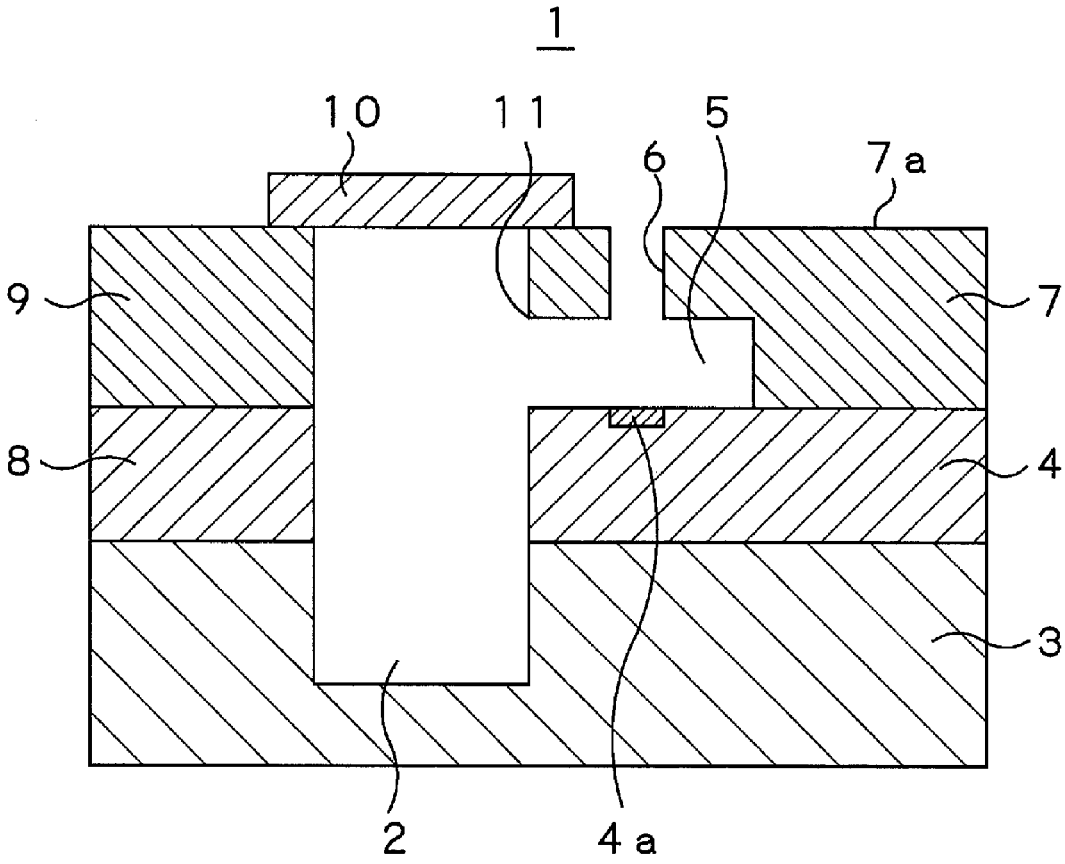
FIG. 2 is a cross-sectional view of the ink jet recording head.

Referring to the drawings, the method for producing a liquid ejecting recording head according to an embodiment of the present invention will now be explained. This liquid ejecting recording head is provided in an ink jet printer adapted for ejecting an ink i as liquid, for example. Referring to FIGS. 1 and 2, an ink jet recording head 1 includes an ink supplying member 3, having a recess 3*a*, forming a part of a common flow duct 2, and a first substrate 4, provided on one side of the recess 3*a* of the ink supplying member 3. The ink jet recording head 1 also includes a first coating resin layer 7, formed on the first substrate 4, and provided with a plural number of individual flow route 5 and the same plural number of nozzles 6, and a second substrate 8, provided on the opposite side of the recess 3*a* of the ink supplying member 3 and matched in height to the first substrate 4. The ink jet recording head 1 further includes a second coating resin layer 9, formed on the second substrate 8, and matched in height to the first coating resin layer 7, and a top plate 10, provided on the first coating resin layer 7 and the second coating resin layer 9 and adapted for closing the common flow duct 2.

In the ink jet recording head 1, there is defined the common flow duct 2 by the ink supplying member 3, an end face of the first substrate 4, an end face of the first coating resin layer 7, an end face of the second substrate 8, an end face of the second coating resin layer 9 and by the top plate 10. Each of the flow routes 5, formed by the first substrate 4 and the first coating resin layer 7, provides a liquid chamber, confining each ink ejecting energy generating device 4*a* therein. In the ink jet recording head 1, the ink i from an ink cartridge, not shown, is supplied to the common flow duct 2, and the ink i, thus supplied to the common flow duct 2, is routed to each of the individual flow routes 5.

The ink supplying member 3, forming a part of the common flow duct 2, is formed e.g. of a resin exhibiting the resistance against the ink, and includes the recess 3*a* which forms a part of the common flow duct 2.

The first substrate 4 is e.g. a silicon substrate, and a plural number of electrical thermal transducers are formed, as ink ejecting energy generating devices 4*a*, on preset surface sites thereof in accordance with a semiconductor manufacturing process. The first substrate 4 is provided with control circuits 4*b* for controlling the ink ejecting energy generating devices 4*a*. The end face of the first substrate 4 towards the common flow duct 2 forms a part of the common flow duct 2. The surface of the first substrate 4, facing the ink ejecting energy generating devices 4*a*, forms the bottom surface of the individual flow route 5. The ink ejecting energy generating device 4*a* is not limited to the electrical thermal transducer, and may also be an electromechanical transducer, such as a piezo device.

The first coating resin layer 7 is formed by patterning on the first substrate 4, and carries the individual flow routes 5 for supplying the ink i from the common flow duct 2 to around the ink ejecting energy generating devices 4*a* provided on the first substrate 4. The individual flow routes 5 are provided in association with the ink ejecting energy generating devices 4*a* and are recessed in a direction perpendicular to the direction of depth of the common flow duct 2. The end parts of the individual flow routes 5 towards the common flow duct 2 are provided with ink supply orifices 11 for communication with the common flow duct 2.

The nozzles 6 communicate with the individual flow routes 5 and are configured for ejecting the ink i in the individual flow routes 5 heated and pressurized by the energy generated by the ink ejecting energy generating device 4*a*.

Specifically, the first coating resin layer 7 is formed by patterning an oxetane resin composition on the surface of the first substrate 4 carrying the ink ejecting energy generating devices 4*a* and by curing the so patterned oxetane resin composition. The oxetane resin composition contains, as necessary components, an oxetane compound having at least one oxetanyl group in a molecule, and a cationic photopolymerization initiator.

The oxetane resin composition, forming the first coating resin layer 7, will now be explained. The oxetane compound in the oxetane resin composition has a four-membered ring which is an oxirane ring of an epoxy plus one carbon atom. The oxetane compound exhibits cationic curing properties higher than those of the epoxy compound. The cured cationic polymer of this oxetane compound has a molecular weight much larger than that of the cured epoxy polymer and is capable of exhibiting high tenacity, elongation, highly reliable mechanical strength, higher water-proofness and higher resistance against chemicals. The features of the cured cationic polymer of this oxetane compound differ significantly from those of the cured epoxy polymer which is hard and brittle. On the other hand, the cured cationic polymer of the oxetane compound does not exhibit mutation inducing action ascribable to the four-membered oxetanyl group and is superior to the photo-curable epoxy resin insofar as safety is concerned.

There are two types of the oxetane compound, namely a monofunctional oxetane compound having a single oxetanyl group in a molecule and a polyfunctional oxetane compound having two or more oxetanyl groups in a molecule. The monofunctional oxetane compound is represented by the following general formula (1):

general formula (1)

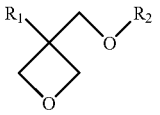

In the general formula (1), R1 denotes a hydrogen atom, a C1 to C6 alkyl group, such as a methyl group, an ethyl group, a propyl group or a butyl group, a C1 to C6 fluoroalkyl group, an allyl group, an aryl group, a furil group or a thienyl group. R2 denotes a C1 to C6 alkyl group, such as a methyl group, an ethyl group, a propyl group or a butyl group, a C2 to C6 alkenyl group, such as a 1-propenyl group, a 2-propenyl group, a 2-methyl-1-propenyl group, a 2-methyl-2-propenyl group, a 1-buthenyl group, a 2-buthenyl group or a 3-buthenyl group, a group having an aromatic ring, such as a phenyl group, a benzyl group, a fluorobenzyl group, a methoxybenzyl group or a phenoxyethyl group, a C2 to C6 alkyl carbonyl group, such as an ethyl carbonyl group, a propyl carbonyl group or a butyl carbonyl group, a C2 to C6 alkyl carbonyl group, such as an ethyl carbonyl group, a propyl carbonyl group or a butyl carbonyl group, a C2 to C6 alkoxy carbonyl group, such as an ethoxy carbonyl group, a propoxy carbonyl group or a butoxy carbonyl group, or a C2 to C6 N-alkyl carbamoyl group, such as an ethyl carbamoyl group, a propyl carbamoyl group, a butyl carbamoyl group or a pentyl carbamoyl group.

The difunctional oxetane compound, having two oxetanyl groups, may be represented by the following general formulas (2) and (3):

general formula (2)

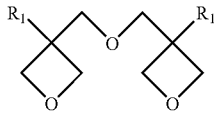

general formula (3)

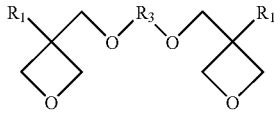

In the general formula (2), R1 has the same meaning as in the general formula (1).

In the general formula (3), R1 has the same meaning as in the general formula (1). R3 is a divalent group selected from the group composed of C1-C12 straight-chained or branched saturated hydrocarbons, C1-C12 straight-chained or branched unsaturated hydrocarbons, aromatic hydrocarbons, represented by the following formulas (A) to (E):

formula (A)

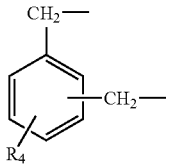

formula (B)

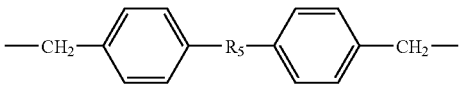

formula (C)

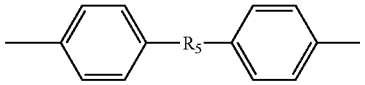

formula (D)

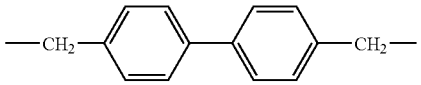

formula (E)

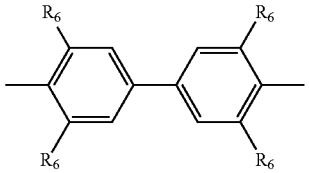

straight-chained or cyclic alkylenes, having carbonyl groups, represented by the formulas (F) and (G):

formula (F)

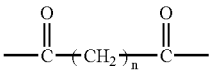

-continued formula (G)

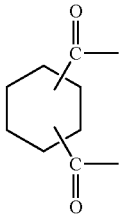

and aromatic hydrocarbons, containing carbonyl groups, represented by the formulas (H) and (I):

formula (H)

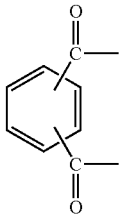

formula (I)

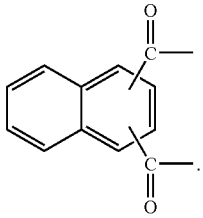

As other difunctional oxetane compounds, there are caldo type compounds and naphthalene type compounds.

In the formulas (A) to (E), R4 denotes a hydrogen atom, a C1-C12 alkyl group, an aryl group or an aralkyl group, R5 denotes —O—, —S—, —$CH_2$—, —NH—, —$SO_2$—, —CH($CH_3$)—, —C($CH_3$)$_2$—, or —C($CF_3$)$_2$— and R6 denotes a hydrogen atom or a C1-C6 alkyl groups.

In the formula (F), n denotes an integer not less than 1.

The tri-functional or higher functional oxetane compounds may be enumerated by phenol-novolak oxetane compounds, represented by the general formula (4), cresol-novolak oxetane compounds, represented by the general formula (5), and by oxetane compounds, having triazine skeletons, represented by the general formulas (6) and (7).

general formula (4)

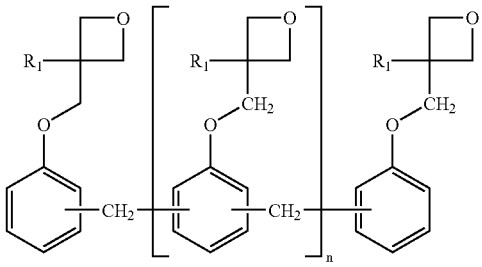

-continued general formula (5)

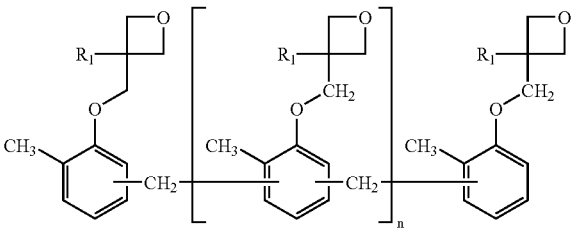

general formula (6)

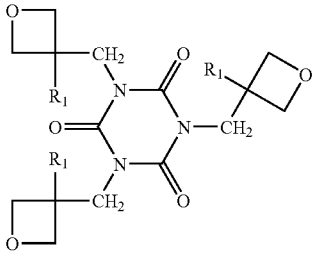

general formula (7)

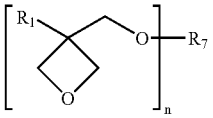

Other tri-functional or higher functional oxetane compounds may be enumerated by poly(hydroxylstyrene), calixarenes, etherified compounds with hydroxyl group containing silicone resins, such as silsesquioxane, and a copolymer of an unsaturated monomer including an oxetane ring with alkyl (meth)acrylate.

In the general formulas (4) and (5), R1 is the same as that in the general formula (1) and n denotes an integer not less than 1. In the novolak oxetane compounds, the number of the number average skeletons is preferably 3 to 10, with n being 1 to 8. If the number of the number average skeletons exceeds 10, the viscosity value becomes higher and the density of the cross-linkage is not increased due to steric hindrance.

In the general formula (6), R1 has the same meaning as in the general formula (1).

In the general formula (7), R1 has the same meaning as in the general formula (1). R7 is a C1-C12 branched alkylene group represented by the following formulas (J), (K) and (L) or aromatic hydrocarbons represented by the following formulas (M), (N) and (P), and n denotes the number of the functional groups, linked to R7, as indicated in the general formula (7).

formula (J)

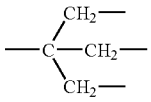

formula (K)

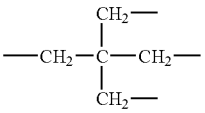

formula (L)

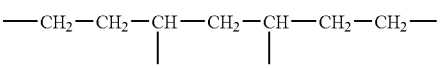

-continued formula (M)

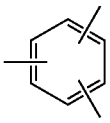

formula (N)

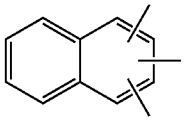

formula (P)

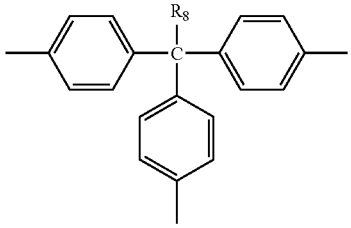

In the formula (P), R8 denotes a hydrogen atom, a C1-C6 alkyl group or an aryl group.

These oxetane compounds are used either singly or as a mixture. In case stronger resistance against chemicals or higher durability is desirable, it is preferred to use polyfunctiuonal oxetane compounds. In case desired viscosity may not be obtained with use of the polyfunctiuonal oxetane compounds, these may be diluted with monofunctiuonal oxetane compounds.

The oxetane compounds ultimately yield a cured compound exhibiting a high cationic curing degree. The rate of curing at the initial reaction stage may be increased by addition of a moderate quantity of an epoxy compound or a vinyl ether compound. The amount of addition in this case is preferably 5 wt % to 95 wt % as referred to the oxetane compound.

Since the first coating resin layer 7 is formed by a cured skeleton, obtained on curing the oxetane resin composition, cationic polymerization initiators are contained, in addition to the above-mentioned oxetane compound, in the oxetane resin composition. In case activation energy rays, such as ultraviolet rays, are illuminated on the oxetane resin composition for patterning, cationic photopolymerization initiators are used. These cationic photopolymerization initiators may be used either singly or in combination.

Examples of the commercially available cationic photopolymerization initiators include CYRACURE UV1-6950 and UVI-6970, manufactured by Union Carbide Corporation, Optomer-SP-150, SP-151, SP-152, SP-170 and SP-171, manufactured by Asahi Denka Kogyo K.K., C1-2855, manufactured by NIPPON SODA CO., LTD., and triaryl sulfonium salts, such as Degacere K185B, manufactured by Degussa Inc., unsaturated or saturated aryl diazonium salts and diaryl iodonium salts. The sulfonic acid derivative may be PAI-101 manufactured by Midori Kagaku Co.,Ltd..

The proportion of the cationic photopolymerization initiator is preferably 2 to 40 parts by weight based on 100 parts by weight of the oxetane compounds. If the proportion of the cationic photopolymerization initiator is lesser than 2 parts by weight, the amount of an acid, generated on irradiation of the activation energy rays, is only small, such that difficulties are met in patterning. If conversely the proportion of the cationic photopolymerization initiator is more than 40 parts by weight, the cationic photopolymerization initiator itself tends to absorb light to lower the sensitivity. If desired to improve the curing degree further, it is possible to use cationic heat polymerization initiator or a cationic photosensitizer in combination.

The first coating resin layer 7 is formed by the oxetane resin composition that contains, as necessary components, an oxetane compound having at least one oxetanyl group in a molecule, and a cationic photopolymerization initiator. Hence, the first coating resin layer may exhibit high mechanical strength, along with high tenacity and high elongation, so that it is possible to prevent inconveniences such as cracking of the resin layer or exfoliation thereof from the first substrate 4.

The first coating resin layer 7 may be added not only by the above-mentioned oxetane resin composition, composed of the oxetane compound and the cationic photopolymerization initiator, but also by a variety of additives as necessary. Preferred as such additives are coupling agents for further improving intimate bonding between the oxetane resin composition and the underlying first substrate 4. As such coupling agents, aluminate-, titanate-, zirconate- or silane-based coupling agents may selectively be used. Of these, the silane-based coupling agents are most desirable.

Examples of the aluminate-based coupling agents include acetoalkoxy aluminum diisopropylate, aluminum diisopropoxy monoethyl acetoacetate, aluminum trisethyl acetoacetate and aluminum trisacetyl acetonate.

Examples of the titanate-based coupling agents include isopropyl tristearoyltitanate, isopropyl tris(dioctylpyrophosphate) titanate, isopropyl tri(N-aminoethyl.aminoethyl) titanate, tetraoctyl bis(ditridecylphosphate) titanate, tetra(2-2 diallyloxymethyl-1-butyl) bis(ditridecyl) phosphate titanate, bis(dioctyl pyrophosphate) oxyacetate titanate and bis(dioctyl pyrophosphate) ethylene titanate.

Examples of the zirconate-based coupling agents include zirconium tetrakisacetyl acetonate, zirconium dibutoxy bisacetyl acetonate, zirconium tetrakisethyl acetoacetate, zirconium tributoxy monoethyl acetoacetate and zirconium tributoxy acetylacetonate.

Examples of the silane-based coupling agents include vinyl trimethoxysilane, vinyl triethoxysilane, 2-(3, 4 epoxycyclohexyl) ethyl trimethoxysilane, 3-glycidoxy propyl trimethoxysilane, 3-mercaptopropyl trimethoxysilane, 3-methacryloxy propyl trimethoxysilane, 3-glycidoxy propylmethyl dimetoxysilane, 3-chloropropyl trimethoxysilane and 3-isocyanate propyl triethoxysilane.

Of the silane-based coupling agents, amino-based coupling agents absorb acids derived from the cationic photopolymerization initiator to lower the sensitivity, and hence are not desirable. The amount of addition of the additive is not less than 0.1 wt % and less than 1 wt %, based on the total weight of the material of the first coating resin layer 7 containing e.g. the oxetane resin composition. If the amount of addition is less than 0.1 wt %, the favorable effect on tight bonding is only low, whereas, if the amount of addition is not less than 1 wt %, the rate of development is lowered appreciably, such that residual development tends to be produced, or the resolution may be lowered.

With the use of an optimum coupling agent, that is, the silane-based coupling agent, in the first coating resin layer 7, the bonding strength on the boundary surface between the first substrate 4 mainly composed of inorganic components and the oxetane resin composition composed of an organic material may be improved. Hence, even though the first coating resin layer is exposed to the ink i, the first coating resin layer may be maintained in a tightly bonded state with respect to the first substrate 4, thus leading to improved operational reliability of the ink jet recording head 1.

The oxetane resin composition, used in forming the first coating resin layer 7, may be in a state dissolved in a solvent. By using the oxetane resin composition dissolved in a solvent, optimum viscosity and coating properties may be obtained when coating the first coating resin layer 7 to a necessary film thickness on the first substrate 4.

It is sufficient that the solvent used is capable of dissolving the oxetane compound or other additives used. Examples of the solvents that may be used include ketones, such as methylethylketone or cyclohexanone, aromatic hydrocarbons, such as toluene, xylene or tetramethylbenzene, and glycol ethers, such as cellosolve, methyl cellosolve, butyl cellosolve, carbitol, methyl carbitol, butyl carbitol, propylene glycol monomethylether, propylene glycol monoethylether, dipropylene glycol diethylether or triethylene glycol monoethylether. Other examples of the solvents used include acetates, such as ethyl acetate, butyl acetate, cellosolve acetate, butyl cellosolve acetate, carbitol acetate, butyl carbitol acetate, propylene glycol monomethylether acetate, or dipropylene glycol monomethylether acetate, alcohols, such as ethanol, propanol, ethylene glycol or propylene glycol, aliphatic hydrocarbons, such as octane or decane, petroleum-based solvents, such as petroleum ether, petroleum naphtha, hydrogenated petroleum naphtha or solvent naphtha, and terpenes, such as limonene. With the use of these solvents, optimum solubility for the oxetane resin composition may be obtained. Of these solvents, the aliphatic hydrocarbons and petroleum-based solvents may be used as the solvents which do not dissolve an ink flow duct pattern 12 of the dissolvable resin layer used for forming the individual flow routes 5 of the ink jet recording head 1 as later explained and which are capable of dissolving the oxetane resin composition. It is noted that the petroleum-based solvents are low in solubility for the dissolvable resin layer used for forming the pattern of the individual flow routes 5 and hence the collapsing of the ink flow duct pattern 12 may occur only on extremely rare occasions.

The first coating resin layer 7, composed of the oxetane resin composition that contains, as necessary components, an oxetane compound having at least one oxetanyl group in a molecule, and a cationic photopolymerization initiator, may be lowered in stress. In addition, high tenacity and elongation as well as highly reliable mechanical strength may be conferred on the first coating resin layer 7, which may not be susceptible to peeling from the first substrate 4 or to cracking. The ink jet recording head 1, provided with the first coating resin layer 7, may be improved in the manufacture yield as well as in the quality, such that high operational reliability may be maintained for prolonged time.

Moreover, the first coating resin layer 7, formed by the cured oxetane resin composition, which is lower in stress than a cured epoxy resin, may be prevented from peeling off from the first substrate 4 more effectively than in the case where the first coating resin layer 7 is formed of the cured epoxy resin composition. Additionally, the first coating resin layer 7 exhibits water-proofness and resistance against chemicals as a result of the content of the oxetane compound.

Furthermore, with the first coating resin layer 7, formed by the oxetane resin composition, the recording head may be elongated in length or thicker in thickness, and hence the individual flow route 5 of complex and intricate structure or the nozzle 6 may be formed with ease to high accuracy.

The first coating resin layer 7 containing optimum additives, that is, silane-based coupling agents, in addition to the oxetane resin composition, may be improved in tightness in affixture with respect to the first substrate 4, and hence may be prevented more effectively from becoming detached from the first substrate 4.

The second substrate 8, affixed to the other side of the recess 3*a* of the ink supplying member 3, is affixed with an adhesive to the ink supplying member 3. This second substrate 8 is provided for setting the height of the one side of the recess 3*a*, the first substrate 4 is bonded to, so as to be equal to that of the other side of the recess. Hence, the second substrate is of the same thickness as the first substrate 4. Similarly to the first substrate 4, the second substrate 8 may be formed by a silicon substrate, however, there is no limitation to the material of the second substrate.

The second coating resin layer 9, formed on the second substrate 8, is formed by e.g. spin coating on the second substrate 8. The second coating resin layer is formed to the same thickness as the first coating resin layer 7 in order to provide for the same height of the side of the recess 3*a* of the ink supplying member 3 carrying the second coating resin layer as that of the side of the recess carrying the first coating resin layer 7. Similarly to the first coating resin layer 7, the second coating resin layer 9 may be formed of the oxetane resin composition, however, there is no limitation to the material type. Meanwhile, the member provided to the opposite side of the recess 3*a* in adjusting the height of one side to that of the other side of the recess 3*a* may be of any suitable material type or structure and may be different than the second substrate 8 or the second coating resin layer 9, provided that the member used is such as sets the same height of one side as that of the opposite side of the recess 3*a*.

The top plate 10 is bonded to an ejecting surface 7*a* of the first coating resin layer 7 ejecting the ink i and to the second coating resin layer 9 to stop up an opening of the common flow duct 2 towards the ejecting surface 7*a* as well as to form a part of the common flow duct 2.

In the ink jet recording head, described above, the first substrate 4 and the first coating resin layer 7 are provided on one side of the recess 3*a* of the ink supplying member 3, whilst the second substrate 8 and the second coating resin layer 9 are provided on the opposite side of the recess 3*a*. The top plate 10 is mounted for overlying the first coating resin layer 7 and the second coating resin layer 9. In the ink jet recording head 1, the common flow duct 2 is delimited by the ink supplying member 3, an end face of the second coating resin layer 9, an end face of the second substrate 8, and end face of the second coating resin layer 9 and by the top plate 10. The plural individual flow routes 5, operating as liquid chambers, and confining the ink ejecting energy generating devices 4*a*, are delimited by the first substrate 4 and the first coating resin layer 7. The individual flow routes communicate with the common flow duct 2. In this ink jet recording head 1, the ink i from the ink cartridge is supplied to the common flow duct 2. The ink i, thus supplied to the common flow duct 2, is then supplied to the individual flow routes 5.

In the ink jet recording head 1, the ink i flows from the ink cartridge into the common flow duct 2 and thence supplied via common flow duct 2 and ink supply orifices 11 to the individual flow routes 5. The ink i is then heated and pressurized by the ink ejecting energy generating devices 4*a* so as to be ejected via nozzles 6 as liquid droplets.

Figure 3A:
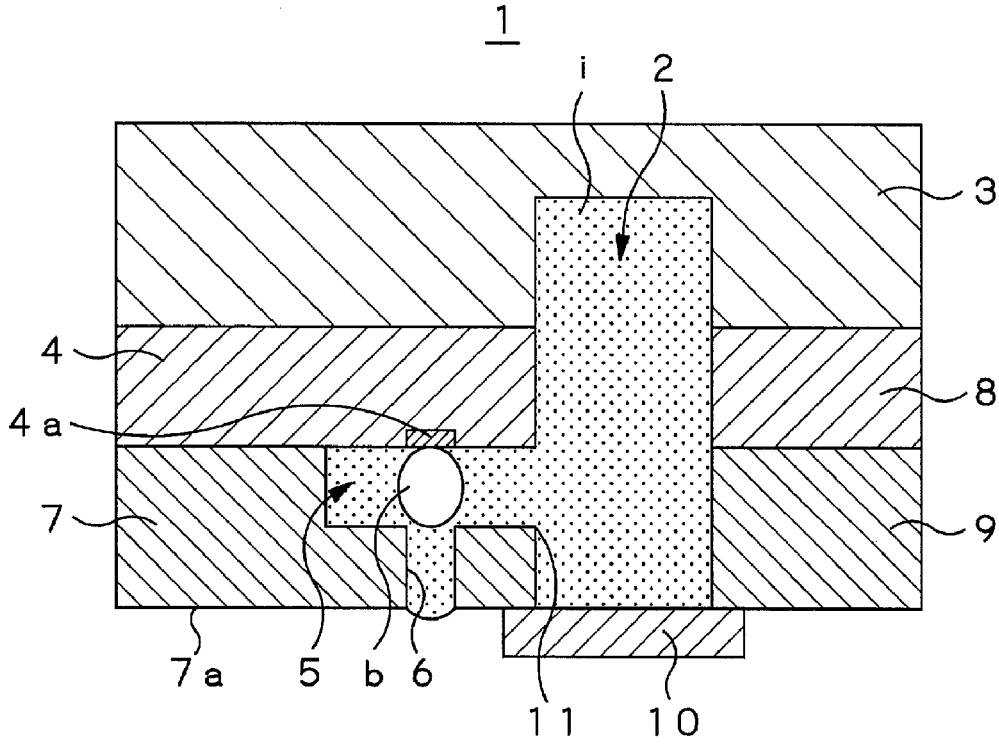
FIGS. 3A and 3B show the ink jet recording head, with FIG. 3A schematically showing, in cross-section, the state in which an air bubble has been generated on an emission energy generating device, and FIG. 3B schematically showing the state in which the ink is being ejected from a nozzle.
Figure 3B:
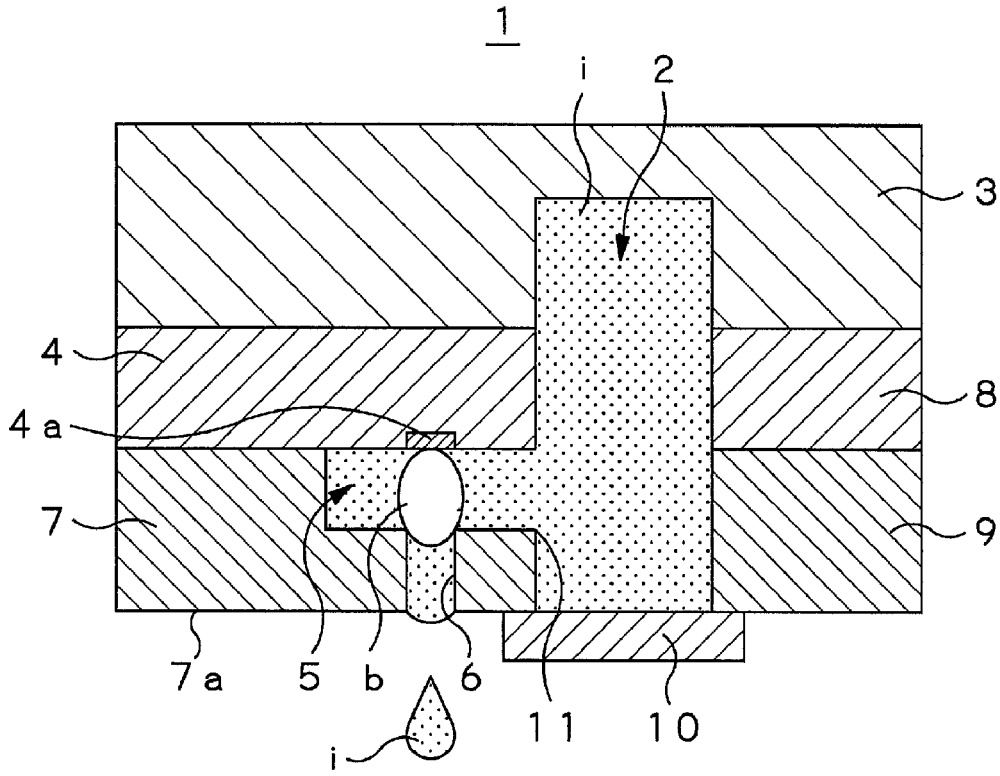

More specifically, when the pulse current is supplied to the ink ejecting energy generating devices 4*a* of the ink jet recording head 1, as shown in FIGS. 3A and 3B, for rapidly heating the ink ejecting energy generating devices 4*a*, an air bubble b is generated in the portion of the ink i contacted with the ink ejecting energy generating device 4*a*, as shown in FIG. 3A. In the ink jet recording head 1, the air bubble b pressurizes the ink i, as the air bubble b is expanded, as shown in FIG. 3B. The ink i, thus pressurized, is ejected from the nozzle 6 as a liquid droplet. After a portion of the ink i has been ejected as liquid droplet, the ink i flows from the ink cartridge to the common flow duct 2 in the ink jet recording head 1. The ink i then is supplied via ink supply orifices 11 into the individual flow routes 5, and hence the state prior to emission is resumed. The above sequence of operations occurs repeatedly for ejecting the ink i in succession.

The method for producing the ink jet recording head 1 will now be described.

Figure 4:
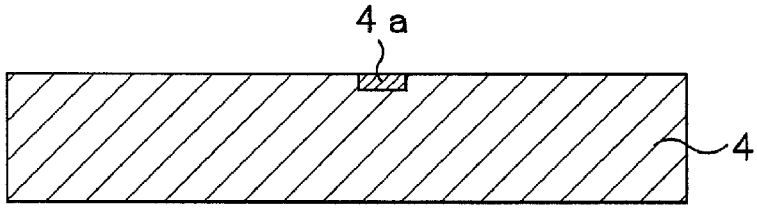
FIG. 4 is a cross-sectional view of a substrate already provided with an ink ejecting energy generating device.

Initially, as shown in FIG. 4, a silicon (Si) substrate is provided as a first substrate 4. A plural number of electrical thermal transducers, as the ink ejecting pressure generating devices 4*a*, are formed by, for example, a semiconductor process, on a surface of this first substrate 4.

Figure 5:
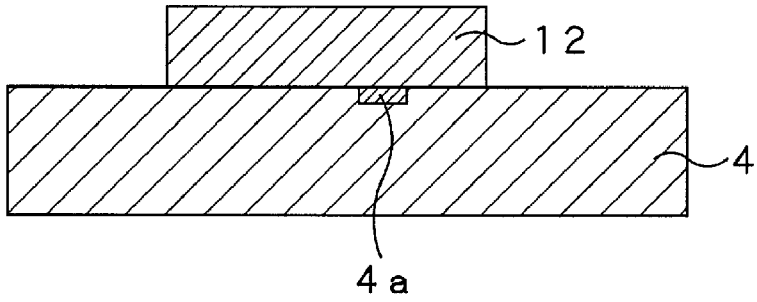
FIG. 5 is a cross-sectional view showing the state in which an ink flow duct pattern has been formed on a substrate with a dissolvable resin.

On the surface of the first substrate 4, carrying the ink ejecting energy generating devices 4*a*, a positive resist (PMER-P-LA900PM, manufactured by TOKYO OKA KOGYO CO.,LTD.), as a layer mainly composed of dissolvable resin, herein a novolak resin, is coated, as adjustment is made of the number of revolutions of a spin coater. The resulting assembly is pre-baked on a hot plate for six minutes at a temperature of say 110° C. Using a mirror projection aligner light exposure device MPA-600FA, manufactured by Canon Inc., the individual flow routes 5 are subjected to pattern light exposure to form an ink flow duct pattern 12 of a dissolvable resin layer on the site which later becomes the individual flow route 5, as shown in FIG. 5. The amount of light exposure at this time is e.g. 800 mJ/cm$^2$.

The resist is then subjected to development by dip development using, for example, a P-7G dedicated developing solution (TMAH (a 3% solution of aluminum hydroxide)), followed by rinsing with pure flowing water. The ink flow duct pattern 12, formed by this dissolvable resin, is formed for preparing the individual flow route 5 provided between the common flow duct 2 and the ink ejecting energy generating device 4*a*. The film thickness following the development is to be ca. 10 μm, as an example.

Figure 6:
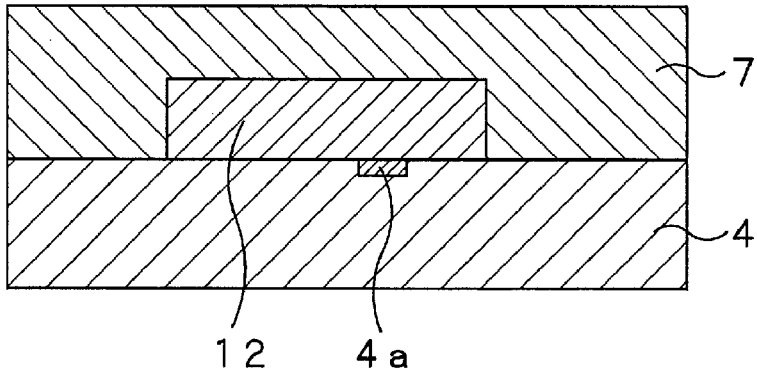
FIG. 6 is a cross-sectional view showing the state in which a first coating resin layer has been formed on an ink flow duct pattern.

The above-described oxetane resin composition then is dissolved in, for example, petroleum naphtha, which does not dissolve the ink flow duct pattern 12, formed of a positive type resist, to a concentration of ca. 50 wt %, to prepare a solution also containing other additives. This solution is spin-coated to form the photosensitive first coating resin layer 7 on the ink flow duct pattern 12, as shown in FIG. 6. This photosensitive first coating resin layer 7, containing an oxetane resin composition and optional additives, is designed to be of a film thickness on the ink flow duct pattern 12 of, for example, 20 μm.

Figure 7:
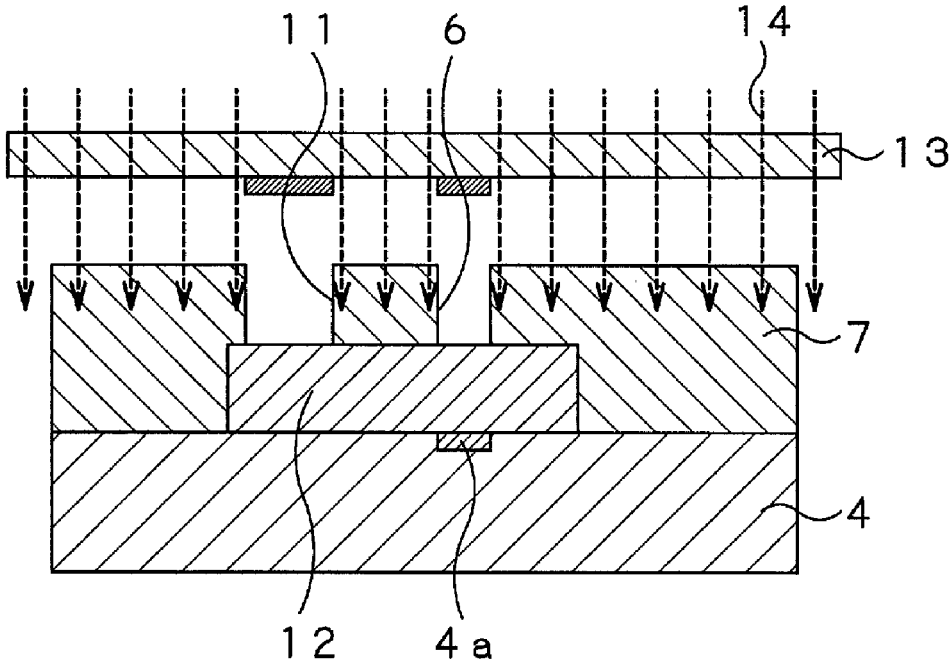
FIG. 7 is a cross-sectional view showing the state in which activation energy rays are being illuminated on the first coating resin layer.

Then, patterned light exposure is carried out, with a mirror projection aligner light exposure device (MPA-600FA manufactured by Canon Inc.), for forming the nozzle 6 and the ink supply orifice 11, as shown in FIG. 7. In effecting this patterned light exposure, activation energy rays 14 are illuminated on the first coating resin layer 7, through a patterned mask 13, so that the portions of the first coating resin layer which later become the nozzle 6 and the ink supply orifice 11 will not be exposed. Meanwhile, the amount of light exposure is e.g. 800 mJ/cm$^2$, and post-baking is carried out at 65° C. for ca. 60 minutes.

Figure 8:
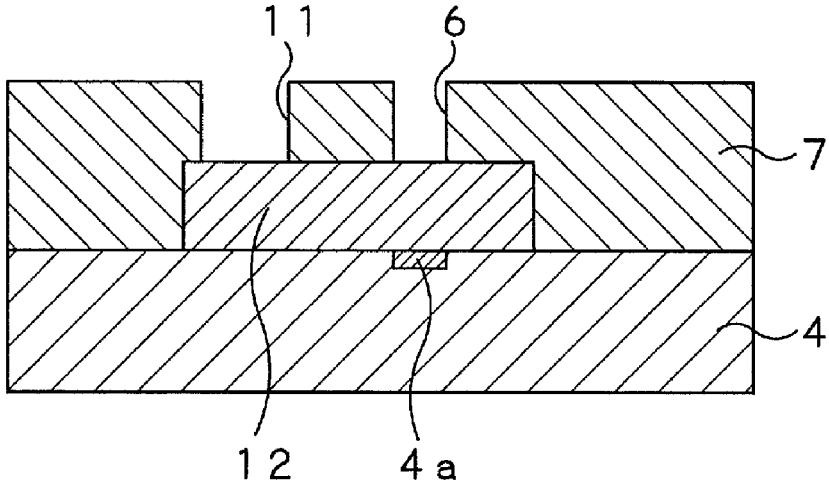
FIG. 8 is a cross-sectional view showing the state in which the first coating resin layer has been formed by patterning.

The portions of the first coating resin layer 7, not exposed to light, are developed with petroleum naphtha, as shown in FIG. 8. The resulting product is immersed in isopropyl alcohol (IPA) for removing development residues, thereby removing the unexposed portions of the first coating resin layer 7 and forming the nozzle 6 and the ink supply orifice 11.

The nozzles 6 are each ca. 15 μm across. The ink flow duct pattern 12 is not soluble in petroleum naphtha and hence is substantially not dissolved but is left intact.

Figure 9:
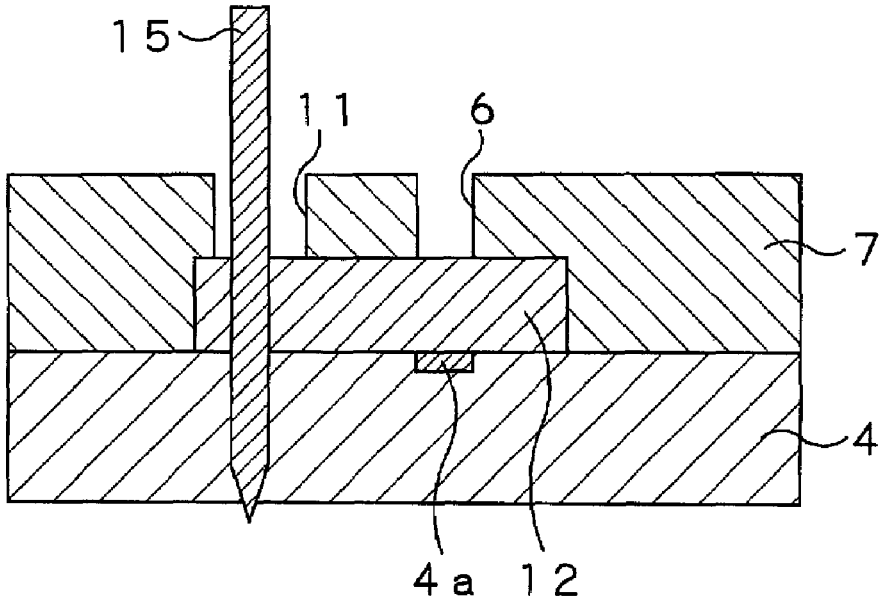
FIG. 9 is a cross-sectional view showing the state in which a substrate, carrying thereon an ink flow duct pattern and a first coating resin layer, is being severed with a dicer.

On the first substrate 4, there are built, at a time, a plural number of the first coating resin layers 7 of the same or different shapes. Thus, the first substrate 4 is sliced at this stage using a dicer 15, for example a dicer manufactured by DISCO Inc. under the trade name of DAD-561, as shown in FIG. 9. Since the ink flow duct pattern 12 is left intact, at this time, any dust and dirt, produced at the time of slicing the first substrate 4, may be prevented from intruding into the individual flow routes 5.

Figure 10:
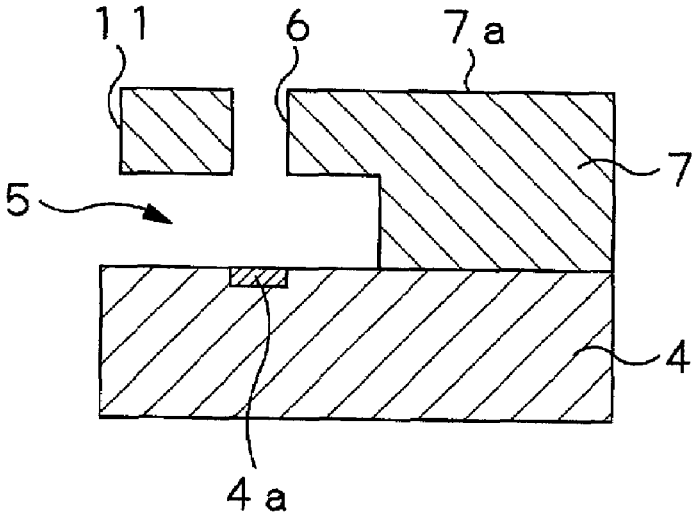
FIG. 10 is a cross-sectional view showing the state in which the ink flow duct pattern has been formed and the dissolvable resin has been dissolved.

The sliced products are then set on e.g. a chip tray, which is then immersed in a propylene glycol monomethylether acetate solution, at the same time as ultrasonic waves are applied to the solution. This solution is used as e.g. a polar solution capable of dissolving a positive type resist. This processing dissolves the ink flow duct pattern 12 which has so far been left intact, as shown in FIG. 10.

The resulting product is heated for post-curing for about one hour at 150° C. for completely curing the photosensitive first coating resin layer 7.

As shown in FIG. 1, the first substrate 4, on which has been layered the first coating resin layer 7, is bonded to one side of the recess 3*a* of the ink supplying member 3, and the second substrate 8, on which has been layered the second coating resin layer 9, is bonded to the other side of the recess 3*a* of the ink supplying member 3. The top plate 10, adapted for closing the ejecting surface 7*a* of the first coating resin layer 7, is bonded to the ejecting surface 7*a* of the first coating resin layer 7 and to the second coating resin layer 9 to complete the ink jet recording head 1.

With the above-described method for producing the ink jet recording head 1, the first coating resin layer 7, carrying the individual flow routes 5 and the nozzles 6, is formed of the oxetane resin composition that contains, as necessary components, an oxetane compound having at least one oxetanyl group in a molecule, and a cationic photopolymerization initiator. As a result, the first coating resin layer 7, suffering from contraction on curing only to a lesser extent and exhibiting mechanical strength as well as tenacity and elongation, to assure high reliability, may be produced. Consequently, with the present ink jet recording head 1, there is no fear of the first coating resin layer 7 becoming cracked or peeled off from the first substrate 4. Moreover, with the present ink jet recording head 1, it is possible to prevent the first coating resin layer 7 from becoming detached from the first substrate 4 even when a load is applied to the ejecting surface 7*a* during cleaning thereof.

Additionally, with the present method for producing the ink jet recording head 1, in which the first coating resin layer 7 is formed of the oxetane resin composition, water-proofness and resistance against chemicals may be afforded, while the first coating resin layer may be prevented from becoming detached even if the layer is in contact with the ink 1.

Furthermore, with the method for producing the ink jet recording head 1, the bonding between the first substrate 4 and the first coating resin layer 7 may be improved in tightness as a result of using the first coating resin layer 7 composed of the oxetane resin composition added by additives, so that there may be obtained the ink jet recording head 1 in which tightness of affixture between the first substrate 4 and the first coating resin layer 7 is maintained to assure high operational reliability for prolonged time.

In the foregoing, the present invention is applied to a printer. However, this is merely illustrative and the present invention may be applied to a large variety of other liquid ejecting devices, such as facsimile or copying devices.

EXAMPLES

The following shows the results of researches into physical properties of the oxetane resin composition, forming the first coating resin layer, and the results of evaluation of the resistance against the ink and printing performance of the ink jet recording head, provided with the so formed first coating resin layer.

<Researches into Physical Properties of the Oxetane Resin Composition>

The following experiments were conducted for scrutinizing into the problem inherent in the resin, that is, the post-curing inner stress of the resin. The inner stress was checked by observing the pre-curing film thickness and the post-curing film thickness of the resin layer. If the two film thicknesses are equal, it may be presumed that the inner stress caused by volumetric changes accompanying the curing of the resin is extremely small.

Example 1

In Example 1, a solution containing an oxetane resin composition, shown in the following Table 1, was spin-coated on a 6-inch wafer. The resulting product was pre-baked on a hot plate at 90° C. for five minutes. Coating was then made to a film thickness of 20 μm followed by exposure to light by a mirror projection light exposure device (MPA 600 FA manufactured by Canon Inc.) to 1J/cm$^2$. After post baking on a hot plate at 90° C. for five minutes, the resulting product was cured at 200° C. for one hour to produce a cured film of the oxetane resin composition.

TABLE 1

| | |
|---|---|
| phenol novolak oxetane compound (average number of basic structures: 3) | 100 parts by weight |
| cationic photopolymerization initiator (SP-170 manufactured by Asahi Denka Kogyo K.K.) | 2 parts by weight |
| silane coupling agent (2-(3,4 epoxy cyclohexyl) ethyl trimethoxysilane | 0.5 part by weight |
| organic solvent (petroleum naphtha: IPSOL150 manufactured by Idemitsu Kosan Co., Ltd) | 100 parts by weight |

Comparative Example 1

In the Comparative Example 1, a cured film of an alycyclic epoxy resin composition was obtained in the same way as in Example 1, using a solution containing the alicyclic epoxy resin composition shown in the following Table 2.

TABLE 2

| | |
|---|---|
| alicyclic epoxy resin (EHPE-3150: DICEL CHEMICAL INDUSTRIES, LTD.) | 100 parts by weight |
| cationic photopolymerization initiator (SP-170 manufactured by Asahi Denka Kogyo K.K.) | 2 parts by weight |
| silane coupling agent (2-(3,4 epoxy cyclohexyl) ethyl trimethoxysilane | 0.5 part by weight |
| organic solvent (xylene) | 100 parts by weight |

Of the cured films, obtained in Example 1 and in Comparative Example 1, film thicknesses after curing on a hot plate at 200° C. for one hour were measured. The results of measurement indicated that, while the film thicknesses were not decreased with the cured films containing the oxetane resin composition shown in Table 1, the film thicknesses were decreased with the cured films containing the alicyclic epoxy resin composition shown in Table 2.

The inner stress, generated in the respective cured films, was then measured, using a thin film stress measurement device. It was seen that the stress in the cured films containing the oxetane resin composition shown in Table 1 was decreased appreciably as compared to that in the cured films containing the alicyclic epoxy resin composition shown in Table 2.

<Evaluation of Resistance Against Ink and Printing Performance of the Ink Jet Recording Head>

Example 2

In the Example 2, the ink jet recording head 1, shown in FIG. 1, was prepared in the following manner. First, the first substrate 4, carrying the ink ejecting energy generating device 4*a*, shown in FIG. 4, was coated with a positive resist, mainly composed of the novolak resin (PMER-P-LA900PM), manufactured by TOKYO OKA KOGYO CO., LTD.), as a dissolvable resin layer. The positive resist was pre-baked on a hot plate at 110° C. for six minutes, after which patterned light exposure was carried out for forming an individual flow route 5, using a projection light exposure device (MPA 600 FA manufactured by Canon Inc.). In this manner, an ink flow duct pattern 12 was formed by the dissolvable resin layer in an area which later become the individual flow route 5, as shown in FIG. 5. The amount of light exposure at this time was 800 mJ/cm$^2$.

The resist was then subjected to development by dip development using, for example, a P-7G dedicated developing solution (TMAH (a 3% solution of aluminum hydroxide)), followed by rinsing with pure flowing water. The film thickness of the positive resist, following the development, was 10 μm.

The above-described oxetane resin composition then was dissolved in, for example, petroleum naphtha, which does not dissolve the ink flow duct pattern 12, to a concentration of ca. 50 wt %. This solution was spin-coated to form the photosensitive first coating resin layer 7 on the ink flow duct pattern 12, as shown in FIG. 6. This photosensitive first coating resin layer 7, containing an oxetane resin composition and optional additives, was designed to be of a film thickness on the ink flow duct pattern 12 of, for example, 20 μm.

Then, patterned light exposure was carried out, with a mirror projection aligner light exposure device MPA-600FA, manufactured by Canon Inc., for forming the nozzle 6 and the ink supply orifice 11, as shown in FIG. 7. In effecting this patterned light exposure, activation energy rays 14 were illuminated on the first coating resin layer 7, through a patterned mask 13, so that the portions of the first coating resin layer which later become the nozzle 6 and the ink supply orifice 11, will not be exposed. Meanwhile, the amount of light exposure was e.g. 800 mJ/cm$^2$, and post-baking was carried out at 65° C. for ca. 60 minutes.

The portions of the first coating resin layer 7, not exposed to light, were developed with petroleum naphtha, as shown in FIG. 8. The resulting product was immersed in IPA for rinsing for removing development residues, thereby removing the unexposed portions of the first coating resin layer 7 and forming the nozzle 6 and the ink supply orifice 11. The nozzle 6 was ca. 15 μm across. The ink flow duct pattern 12 was not soluble in petroleum naphtha and hence was substantially not dissolved but was left intact.

The first substrate was sliced at this stage using a dicer 15, for example a dicer manufactured by DISCO CORPORATION under the trade name of DAD-561, as shown in FIG. 9. Since the ink flow duct pattern 12 was left intact, at this time, any dust and dirt, produced at the time of slicing the first substrate 4, may be prevented from intruding into the individual flow routes 5.

The sliced products were then set on e.g. a chip tray, which was then immersed in a propylene glycol monomethylether acetate solution, as ultrasonic waves were applied to the solution. This solution was used as e.g. a polar solution capable of dissolving a positive type resist. This processing dissolved the ink flow duct pattern 12 which so far was left intact, as shown in FIG. 10.

The resulting product was heated for post-curing for about one hour at 150° C. for completely curing the photosensitive first coating resin layer 7.

As shown in FIG. 1, the first substrate 4, on which was layered the first coating resin layer 7, was bonded to one side of the recess 3*a* of the ink supplying member 3, and the second substrate 8, on which was layered the second coating resin layer 9, was bonded to the other side of the recess 3*a* of the ink supplying member 3. The top plate 10 was bonded to the ejecting surface 7*a* of the first coating resin layer 7 and to the second coating resin layer 9 to complete the ink jet recording head 1.

Comparative Example 2

In the Comparative Example 2, an ink jet recording head 1 was prepared in the same way as in Example 2, except forming the coating resin layer with the solution containing the epoxy resin composition shown in Table 2 and developing this coated resin layer with xylene.

The ink jet recording heads 1 of the Example 2 and the Comparative Example 2 were immersed in black ink at 60° C. for one week by way of an ink immersion test. As the black ink, an ink composed of pure water, ethylene glycol and black dye, manufactured by Sony Corporation for LPR-5000, was used.

The results of the ink immersion test indicated that, with the ink jet recording head 1 of Example 2, in which the first coating resin layer 7 was formed of the oxetane resin composition, shown in Table 1, such changes as peeling off of the first coating resin layer 7 from the first substrate 4 were not observed. Conversely, with the ink jet recording head 1 of the Comparative Example 2, in which the first coating resin layer 7 was formed of the alicyclic epoxy resin composition, shown in Table 2, it was seen that the first coating resin layer 7 was partially peeled off, after the immersion in the ink, possibly due to the stress ascribable to the curing.

As for evaluation of the printing performance, the ink jet recording heads 1 of the Example 2 and the Comparative Example 2 were mounted on a recording device and recording was carried out using an ink composed of pure water/diethylene glycol/black dye=80/17.5/2.5. It was found that, with the ink jet recording head 1 of Example 2, stabilized printing could be carried out, and the print obtained was of high quality. Conversely, it was found that, with the ink jet recording head 1 of the Comparative Example 2, the print quality was not stabilized. Moreover, with the ink jet recording head 1 of the Comparative Example 2, the state of the recording head after prolonged use demonstrated interference fringes, felt to be caused by peeling off of the coated resin layer, as evidenced on observation with an optical microscope.

It should be understood by those skilled in the art that various modifications, combinations, sub-combinations and alterations may occur depending on design requirements and other factors insofar as they are within the scope of the appended claims or the equivalents thereof.

What is claimed is:

1. A method for producing a liquid ejecting recording head comprising the steps of:

forming a liquid flow duct pattern, from a dissolvable resin, in a portion of a substrate carrying a liquid ejecting energy generating device, said portion later becoming a liquid flow duct;

forming a coated resin layer on said dissolvable resin on which said liquid flow duct pattern has been formed;

forming a liquid ejecting opening in a portion of said coating resin layer overlying said liquid ejecting energy generating device; and dissolving said dissolvable resin; wherein said coating resin layer is formed of an oxetane resin composition that contains, as necessary components, an oxetane compound having at least one oxetanyl group in a molecule, and a cationic photopolymerization initiator, and in said coated resin layer forming step, (a) a solution of feedstock components of said oxetane resin composition and said cationic photopolymerization initiator dissolved in a solvent which does not dissolve said dissolvable resin, is used and (b) a cured product of said feedstock components of said solution is generated, said dissolvable resin being dissolved to exit said liquid ejecting opening to form said liquid flow duct communicating with said liquid ejecting opening.

2. The method for producing a liquid ejecting recording head according to claim 1 wherein said oxetane compound includes an aromatic ring in a molecule.

3. The method for producing a liquid ejecting recording head according to claim 2 wherein the skeleton of said oxetane compound is of a novolak type.

4. The method for producing a liquid ejecting recording head according to claim 3 wherein the number of the number averaged basic structures is 3 to 10.

5. The method for producing a liquid ejecting recording head according to any one of claims 1 to 4 wherein said coated resin layer includes a coupling agent.

6. The method for producing a liquid ejecting recording head according to claim 5 wherein said coupling agent is a silane-based coupling agent.

7. The method for producing a liquid ejecting recording head according to claim 6 wherein the content of said silane-based coupling agent is not less than 0.1 wt % and less than 1 wt %.

8. The method for producing a liquid ejecting recording head according to claim 1 wherein the solvent which does not dissolve the dissolvable resin is an aliphatic hydrocarbon or a petroleum-based solvent.

* * * * *